United States Patent [19]

Haswell et al.

[11] Patent Number: 4,609,526

[45] Date of Patent: Sep. 2, 1986

[54] METHOD FOR COMPACTING ALLOY POWDER

[75] Inventors: Walter T. Haswell, Jamesville, N.Y.; Charles F. Yolton, Coraopolis, Pa.

[73] Assignee: Crucible Materials Corporation, Pittsburgh, Pa.

[21] Appl. No.: 609,959

[22] Filed: May 14, 1984

[51] Int. Cl.[4] ..... B22F 1/00

[52] U.S. Cl. ..... 419/23; 72/402; 419/31; 419/42; 419/48; 419/49

[58] Field of Search ..... 419/48, 42, 66, 68, 419/23, 31, 49; 72/402

[56] References Cited

U.S. PATENT DOCUMENTS

| | | | |
|---|---|---|---|
| 3,787,205 | 1/1974 | Church | 419/48 |
| 3,834,004 | 9/1974 | Ayers | 419/48 |
| 3,897,618 | 8/1975 | Church | 419/48 |
| 4,069,042 | 1/1978 | Buchovecky | 419/8 |
| 4,414,028 | 11/1983 | Inoue | 419/42 |
| 4,452,756 | 6/1984 | McLeod | 419/48 |
| 4,460,541 | 7/1984 | Singleton et al. | 419/42 |

OTHER PUBLICATIONS

Henderson et al., 1953, Metallurgical Dictionary, Reinhold Publ. Co., N.Y., p. 322.

*Primary Examiner*—Stephen J. Lechert, Jr.
*Attorney, Agent, or Firm*—Finnegan, Henderson, Farabow, Garrett & Dunner

[57] ABSTRACT

A method for producing high speed, tool and die steel articles from prealloyed powders. The method comprises placing particles of a prealloyed steel composition from which the article is to be made in a deformable container, heating the container and particles and then passing the heated container through a forging box having a plurality of hammers evenly spaced around the container and adapted to extend and retract radially to impart a radial forging action to the container. The forging action is of a magnitude and duration to compact the particles to an essentially fully dense article. Preferably, there are four hammers arranged in two pairs with the hammer of each pair being opposed and adapted to extend and retract in unison.

9 Claims, 3 Drawing Figures

1000 X

1000 X

1000 X

METHOD FOR COMPACTING ALLOY POWDER

It is known to produce high speed, tool and die steel articles from prealloyed particles of the steel from which the articles are to be made. Various powder metallurgy techniques are used for this purpose.

Typically the particles are produced from a prealloyed molten charge of the steel, which charge is atomized to produce the required particles. Atomization is effected typically by providing a stream of the molten material that is atomized by striking it with a jet or jets of an inert gas, such as nitrogen and argon. The gas in the form of a jet strikes the molten steel stream and atomizes it into discrete droplets. The droplets are cooled and collected in an inert atmosphere chamber to prevent contamination of the particles as by oxidation. Because of the rapid cooling and solidification of the particles, they are of uniform metallurgical structure and composition and characterized by fine and evenly dispersed carbides. In high speed, tool and die steels carbides are provided for purposes of both hardness and wear resistance. Conventionally, these carbides are of tungsten, vanadium and molybdenum. It is well known that fine carbides of these types contribute to important properties of the powder metallurgy article, such as grindability, wear resistance and ductility or resistance to cracking.

Carbides of these types are affected by heating. Specifically, it has been determined that the carbides become larger as heating progresses above the fusion temperature of the particular steel alloy. The fusion temperature is the temperature at which the particles experience incipient melting and fusion together in the absence of pressure application. This temperature will vary from alloy to alloy but may be readily determined for any specific alloy experimentally. This same phenomenon of carbide growth, of course, occurs during conventional ingot casting of high speed, tool and die steels. Because of the mass of the casting cooling is of necessity relatively slow and during cooling carbide growth and agglomeration occur. Also, inhomogeneities in the casting structure are likewise brought about by slow cooling of the casting. For this reason, in steels of this type powder metallurgy techniques have become prominent as a practice for achieving improved product quality.

A typical powder metallurgy technique involves using gas atomized powders that are placed in a deformable container, which may be made from mild steel, which is heated, outgassed to remove impurities such as oxygen and the like as gaseous reaction products, and then placed in a gas pressure vessel, commonly termed an autoclave, wherein pressures on the order of 10,000 to 20,000 psi are used to isostatically compact the particles to essentially full density. Gases such as argon may be used in the autoclave.

Hot isostatic pressing techniques using autoclaves have been successful in producing the desired product quality. They are, however, relatively expensive both from the standpoint of construction and operation, particularly from the standpoint of product production rate.

It is accordingly a primary object of the present invention to provide a powder metallurgy practice for producing high speed, tool and die steel articles that provides an article having structure and properties comparable to that achieved by hot isostatic compacting in an autoclave using lower cost equipment and operation and having a relatively high rate of productivity.

A more specific object of the invention is to provide a method for producing high speed, tool and die steel articles by a powder metallurgy technique that uses a mechanical compacting operation that obviates the need to hot isostatically compact in an autoclave.

These and other objects of the invention, as well as a more complete understanding thereof, may be obtained from the following description and specific examples.

Figure 1:
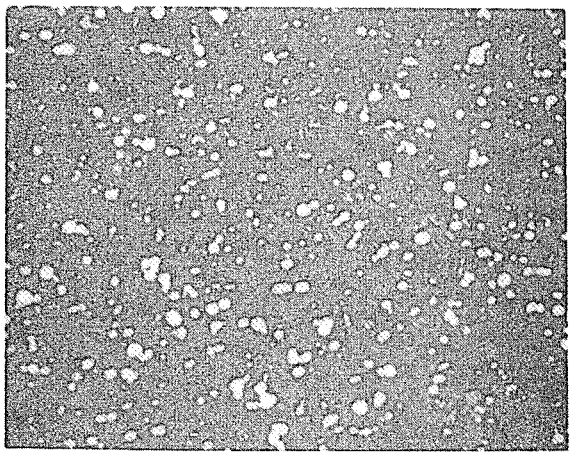
FIG. 1 is a photomicrograph at a magnification of 1000× of a representative portion of a sample compact produced in accordance with the invention.

Broadly, the invention comprises placing prealloyed particles of the steel from which the powder metallurgy articles are to be made in a deformable container. This container may be that typically used in hot isostatic compacting operations which is a container made from mild carbon steel. Typically, the container is elongated and cylindrical to the typical shape of a billet. The container after being filled with the particles is prepared in the conventional manner for compacting. This may involve heating, outgassing to remove gaseous reaction products and then sealing the container against the atmosphere. In accordance with the invention the sealed container is heated to a suitable compacting temperature and is then passed along a feed path having an axis through a forging box, which forging box has a plurality of hammers evenly spaced around the container. The hammers are adapted to extend and retract radially with respect to the axis to impart a radial forging action to the container as the container passes through the forging box. This forging action is of a magnitude and duration to compact the particles to an essentially fully dense article.

The particles are typically heated to a temperature of above about 0.7 of the fusion temperature of the particles and below the temperature of fusion of the particles. This temperature will vary from alloy to alloy but may be readily determined for any specific alloy experimentally. For high speed, tool and die steel this will typically result in a temperature range of about 1800° F. to 2200° F. It is preferred to use spherical particles of the type conventionally produced by gas atomization. The particles are typically not larger than about −16 mesh U.S. Standard.

Outgassing, if required, may be performed by heating the powder filled container to a temperature below the compacting temperature and then connecting the interior of the container to a pump which removes from the container gaseous reaction products liberated by the heating operation. Preferably, the forging box has four hammers which are evenly spaced around the container. The four hammers may be arranged preferably in two pairs with the hammers of each pair being opposed and adapted to extend and retract substantially in unison. In this manner, the hammers strike at a rate of 175 to 200 times per minute. In this manner the circumference of the container as it is moved longitudinally through the forging box is subjected to an all-sided sequential forging operation. The operation provides for uniform, rapid forging along the entire circumference so that essentially full density is achieved. The apparatus suitable for use with the practice of the invention may be that described in Kralowetz U.S. Pat. No. 3,165,012. The forging machine of this patent has four hammers which are radially directed toward the axis of the workpiece, which workpiece is moved longitudinally through a forging box embodying the hammers which are driven by driving shafts eccentrically mounted to cause the hammers to perform a reciprocating, sequential forging action.

As a specific example of the practice of the invention conventional alloys of M4 and 10V tool steels of the following compositions, in percent by weight, were processed in accordance with the invention:

| | Mo | W | V | Cr | C | Mn | Si | S | Fe |
|---|---|---|---|---|---|---|---|---|---|
| M4 | 4.5 | 5.5 | 4.0 | 4.0 | 1.3 | 0.3 | 0.3 | — | Bal. |
| 10V (AISI All) | 1.3 | — | 9.75 | 5.25 | 2.45 | 0.5 | 0.9 | .07 | Bal. |

These compositions were produced conventionally in the form of gas atomized spherical particles by a conventional practice which included the steps of induction melting to produce the desired prealloyed composition, pouring the molten alloy through a nozzle to produce a molten stream thereof, gas atomizing the molten stream in a protective atmosphere, collecting the solidified particles and screening to remove oversize particles.

Powders of these compositions were loaded into mild carbon steel cylindrical containers having a length of 60" and an outside diameter of 14¾". The powder loaded into containers was of a size consisting of −16 mesh U.S. Standard. The containers were connected to a pump for outgassing of the container interiors and simultaneously heated to a temperature of 2170° F. After outgassing the containers were sealed against the atmosphere and placed in a gas-fired furnace at 1200° F. The furnace temperature was increased over a period of 10 hours to achieve a final compact temperature of 2125° F. The powder filled containers were then processed in an apparatus similar to that of U.S. Pat. No. 3,165,012 for compacting by forging to essentially full density. The forging schedule for these compacts was as follows:

| Pass No. | Size (in.) | % Reduction/Pass |
|---|---|---|
| — | 14.75 Rd. | — |
| 1 | 11.8 × 12.8 | 11.2 |
| 2 | 11.8 × 10.0 | 21.5 |
| 3 | 9.4 × 10.0 | 20.0 |
| 4 | 9.4 × 7.6 | 23.9 |
| 5 | 7.6 × 7.6 | 19.2 |
| | Reheat to 2125° F. | |
| — | 7.6 × 7.6 | — |
| 1 | 8.6 Rd. | 0 |
| 2 | 6.7 Rd. | 40.3 |
| 3 | 5.5 × 5.5 | 13.6 |

Samples of the M4 composition produced in accordance with the invention and as specifically set forth in the above forging schedule were subjected to Charpy C-notch impact tests and then fracture strength tests, the results of which are set forth in Table I.

TABLE I

CHARPY C-NOTCH IMPACT AND BEND FRACTURE STRENGTH OF INVENTION FORGED CPM M4
5.5 INCH RCS - HEAT P69398-1
65% REDUCTION

| Heat Treatment | HRC | Test Dir. | C-Notch Impact Strength (ft.-lb.) Test Values | Avg | Bend Fracture Strength (ksi) Test Values | Avg |
|---|---|---|---|---|---|---|
| 2200 F. 4 hrs. | 65 | L | 9.5,6.5,8.5 | 8.2 | 531,539 | 535 |
| OQ*/1050 F. | | T | 7.0,5.5,7.5 | 6.6 | 451,469 | 460 |
| 2 + 2 + 2 hrs. | | | | | | |
| 2125 F. 4 hrs. | 63 | L | 8.0,8.0,8.0 | 8.0 | 571,532,613 | 572 |
| OQ*/1050 F. | | T | 6.0,7.5,9.5 | 7.6 | 504,475,504 | 494 |
| 2 + 2 + 2 hrs. | | | | | | |

*Oil quenched

For comparison similar samples were likewise tested of the same alloy composition produced by conventional hot isostatic pressing in an autoclave followed by forging and additional conventional product produced by casting followed by forging and rolling. It may be seen from Tables I and II that the properties of the material produced according to the invention were similar to the conventional CPM product produced by hot isostatic pressing followed by forging. The properties of the conventional cast and wrought material were likewise comparable but this material was subjected to a much greater reduction during hot working, which is known to significantly increase properties.

Figure 2:
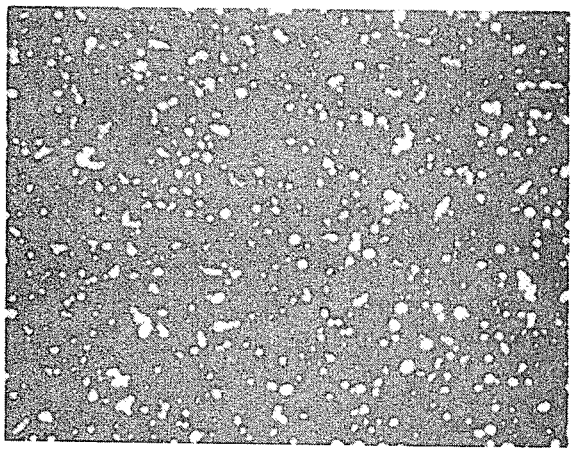
FIG. 2 is a similar photomicrograph of a sample produced by conventional hot isostatic compacting.
Figure 3:
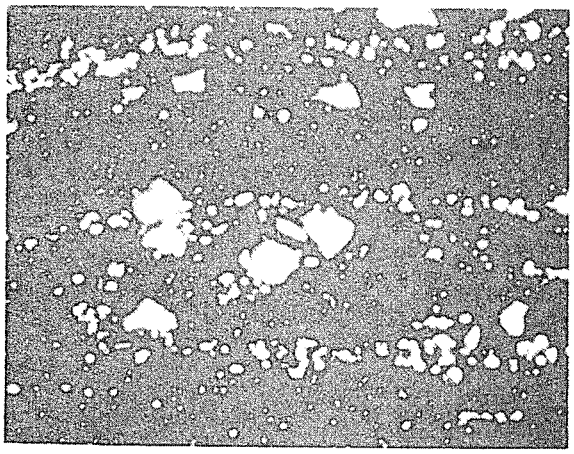
FIG. 3 is a similar photomicrograph of a sample of conventionally cast and wrought material.

Photomicrographs were prepared at a magnification of 1000× at representatives areas of the material produced in accordance with the invention, the hot isostatically pressed material and the conventional cast and wrought material which photomicrographs are identified as FIG. 1, FIG. 2 and FIG. 3, respectively. It may be seen that the photomicrographs of FIGS. 1 and 2 are substantially the same indicating that the practice of the invention produces a homogeneous finely distributed carbide structure substantially the same as that produced by hot isostatic compacting in an autoclave. In contrast, FIG. 3 shows that the conventional cast and wrought material is characterized by large and agglomerated carbides with the structure being nonhomogeneous.

All of the samples of FIGS. 1, 2 and 3 are of AISI M4 tool steel composition.

TABLE II

CHARPY C-NOTCH IMPACT AND BEND FRACTURE STRENGTH OF STANDARD CPM LARGE BAR AND CONVENTIONAL SMALL BAR M4 TOOL STEEL

| Product | Product Size | HRC | Test Dir. | C-Notch Impact Strength (ft.-lb.) Test Values | Avg. | Bend Fracture Strength (ksi) Test Values | Avg. |
|---|---|---|---|---|---|---|---|
| CPM* | 8 1/16" Dia. | 65.5 | L | 7,8,7.5 | 7.5 | 516,512,513 | 514 |
| | 53% reduction | | T | 4.5,6.5,5 | 5 | 477,392,475 | 448 |
| | | 63.5 | L | 9,7.5,10 | 9 | 537,531,531 | 533 |

TABLE II-continued

CHARPY C-NOTCH IMPACT AND BEND FRACTURE STRENGTH OF STANDARD CPM LARGE BAR AND CONVENTIONAL SMALL BAR M4 TOOL STEEL

| Product | Product Size | HRC | Test Dir. | C-Notch Impact Strength (ft.-lb.) Test Values | Avg. | Bend Fracture Strength (ksi) Test Values | Avg. |
|---|---|---|---|---|---|---|---|
| | | | T | 7,7,4.5 | 6 | 505,487,335 | 442 |
| Conventional+ | 2" Dia. | 64 | L | 11,10,10 | 10 | 520,543,497 | 520 |
| | 97% reduction | 63 | L | 12,12,13 | 12 | 569,562,572 | 568 |

*HIP and Forge
+Cast and Wrought

We claim:

1. A method for producing high speed, tool and die steel articles from prealloyed, gas-atomized, substantially spherical particles of the steel from which said articles are to be made, said method comprising placing said particles in a deformable container, heating said particles within said container and passing said container with said heated particles therein along a feed path having an axis through a forging box having a plurality of hammers evenly spaced around said container and adapted to extend and retract radially with respect to said axis to impart a radial forging action to said container as said container passes through said forging box, said forging action being of a magnitude and duration to compact said particles to an essentially fully dense article.

2. The method of claim 1 wherein said particles are heated to a temperature above about 0.7 of the fusion temperature of said particles.

3. The method of claim 1 wherein said particles are heated to a temperature above about 0.7 of fusion temperature of said particles and below the temperature of fusion of said particles.

4. The method of claim 1 wherein said particles are not larger than about −16 mesh.

5. A method for producing high speed, tool and die steel articles from prealloyed, gas-atomized, substantially spherical particles of the steel from which said articles are to be made, said method comprising placing said particles in a deformable container, heating said particles within said container and passing said container with said heated particles therein along a feed path having an axis through a forging box having four hammers evenly spaced around said container and adapted to extend and retract radially with respect to said axis to impart a radial forging action to said container as said container passes through said forging box, said forging action being of a magnitude and duration to compact said particles to an essentially fully dense article.

6. The method of claim 5 wherein said four hammers are arranged in two pairs with the hammers of each pair being opposed and adapted to extend and retract in unison.

7. The method of claim 6 wherein said particles are heated to a temperature above about 0.7 of the fusion temperature of said particles.

8. The method of claim 6 wherein said particles are heated to a temperature above about 0.7 of the fusion temperature of said particles and below the temperature of fusion of said particles.

9. The method of claim 6 wherein said particles are not larger than about −16 mesh.

* * * * *